United States Patent [19]

Taguchi

[11] Patent Number: 4,817,141

[45] Date of Patent: Mar. 28, 1989

[54] CONFIDENTIAL COMMUNICATION SYSTEM

[75] Inventor: Tetsu Taguchi, Tokyo, Japan

[73] Assignee: NEC Corporation, Tokyo, Japan

[21] Appl. No.: 38,831

[22] Filed: Apr. 15, 1987

[30] Foreign Application Priority Data

Apr. 15, 1986 [JP] Japan ..... 61-87422

[51] Int. Cl.[4] ..... H04R 1/04

[52] U.S. Cl. ..... 380/9; 380/38; 380/39

[58] Field of Search ..... 380/9, 38, 39, 50, 34; 381/30, 49, 51

[56] References Cited

U.S. PATENT DOCUMENTS

| | | | |
|---|---|---|---|
| 4,015,088 | 3/1977 | Dubnowski et al. | 381/49 |
| 4,064,363 | 12/1977 | Malm | 381/51 |
| 4,130,729 | 12/1978 | Gagnon | 381/30 |
| 4,140,876 | 2/1979 | Gagno | 381/30 |
| 4,232,194 | 11/1980 | Adams | 380/9 |
| 4,330,689 | 5/1982 | Kang et al. | 380/9 |
| 4,550,222 | 10/1985 | Hanni et al. | 380/34 |
| 4,551,580 | 11/1985 | Cox et al. | 380/9 |
| 4,574,392 | 3/1986 | Reiss | 381/51 |
| 4,578,816 | 3/1986 | Rabain et al. | 380/34 |
| 4,612,414 | 9/1986 | Juang | 380/9 |
| 4,623,980 | 11/1986 | Vary | 380/38 |

*Primary Examiner*—Salvatore Cangialosi

*Attorney, Agent, or Firm*—Foley & Lardner, Schwartz, Jeffery, Schwaab, Mack, Blumenthal & Evans

[57] ABSTRACT

The respective feature parameters extracted from a speech signal is converted into the corresponding line spectrum data in a first frequency band obtained by dividing the speech signal frequency band. Each of the line spectrum data is allocated previously to each one of the feature parameters. The extracted feature parameters are further converted into the corresponding line spectrum data in the other divided frequency bands other than the first frequency band. The converted line spectrum data are multiplexed for transmission. The corresponding line spectrum data in the divided frequency bands allocated to the same feature parameter are logically added to restore the feature parameters. Thus higher confidential communication is realized.

24 Claims, 12 Drawing Sheets

FIG. 10

FILTER COEFFICIENT

(a) FILTER COEFFICIENTS

--- tn-12 tn-11 tn-10 tn-9 tn-8 tn-7 tn-6 tn-5 tn-4 tn-3 tn-2 tn-1 (1~2, 3~4 KHz) BPF

--- Un-12 Un-11 Un-10 Un-9 Un-8 Un-7 Un-6 Un-5 Un-4 Un-3 Un-2 Un-1 (0~1, 2~3 KHz) BPF

FILTER INPUT OUTPUT

(b)[1] PHASE 0; SAMPLED DATA

--- $y_2$ 0 0 0 $y_1$ 0 0 0 $y_0$ 0 0 0

(b)[2] OUTPUT--- $y_2$ (Un-12+tn-12) + $y_1$ (Un-8-tn-8) + $y_0$ (Un-4+tn-4)

(c)[1] PHASE 1 ; SAMPLED DATA

--- 0 $y_2$ 0 0 0 $y_1$ 0 0 0 $y_0$ 0 0

(c)[2] OUTPUT--- $y_2$ (Un-11+tn-11) + $y_1$ (Un-7-tn-7) + $y_0$ (Un-3+tn-3)

(d)[1] PHASE 3 ; SAMPLED DATA

--- 0 0 0 $y_2$ 0 0 0 $y_1$ 0 0 0 $y_0$ (d)[2] OUTPUT--- $y_2$ (Un-9+tn-9) + $y_1$ (Un-5-tn-5) + $y_0$ (Un-1+tn-1)

(e)[1] PHASE 4 ; SAMPLED DATA

--- $y_3$ 0 0 0 $y_2$ 0 0 0 $y_1$ 0 0 0

(e)[2] OUTPUT--- $y_3$ (Un-12-tn-12) + $y_2$ (Un-8+tn-8) + $y_1$ (Un-4-tn-4)

(f)[1] PHASE 7 ; SAMPLED DATA

--- 0 0 0 $y_3$ 0 0 0 $y_3$ 0 0 0 $y_1$ (f)[2] OUTPUT--- $y_3$ (Un-9-tn-9) + $y_2$ (Un-5+tn-5) + $y_1$ (Un-1-tn-1)

(g)[1] PHASE 0 ; SAMPLED DATA

--- $y_4$ 0 0 0 $y_3$ 0 0 0 $y_2$ 0 0 0

(g)[2] OUTPUT--- $y_4$ (Un-12+tn-12) + $y_3$ (Un-8-tn-8) + $y_2$ (Un-4+tn-4)

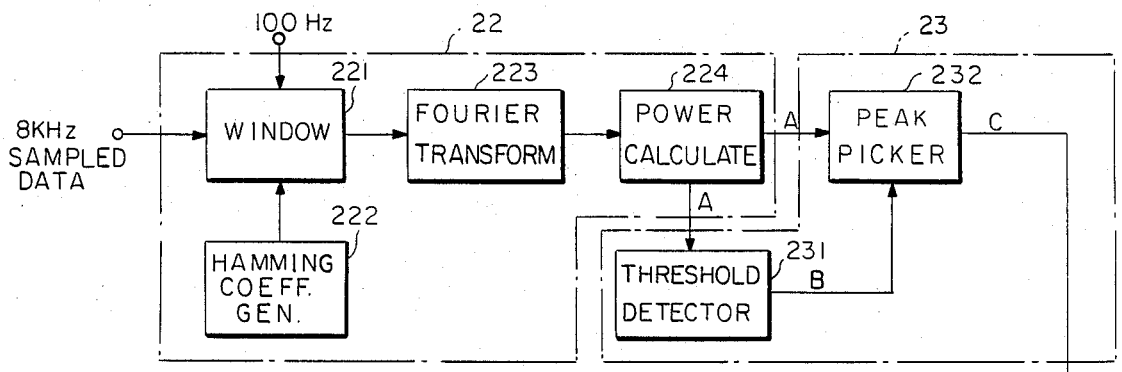
FIG. 11
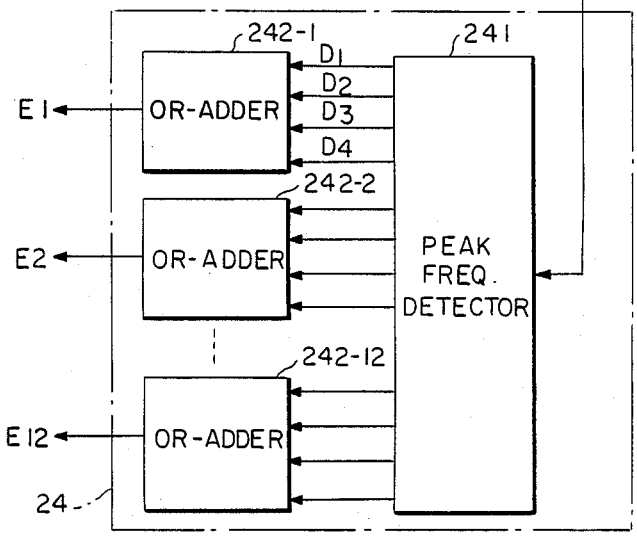
FIG. 13
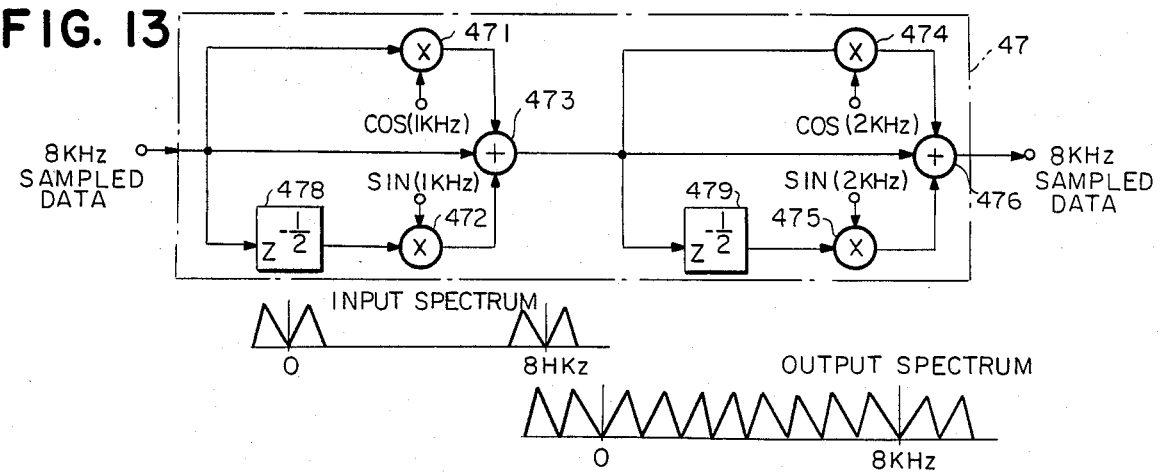
FIG. 15
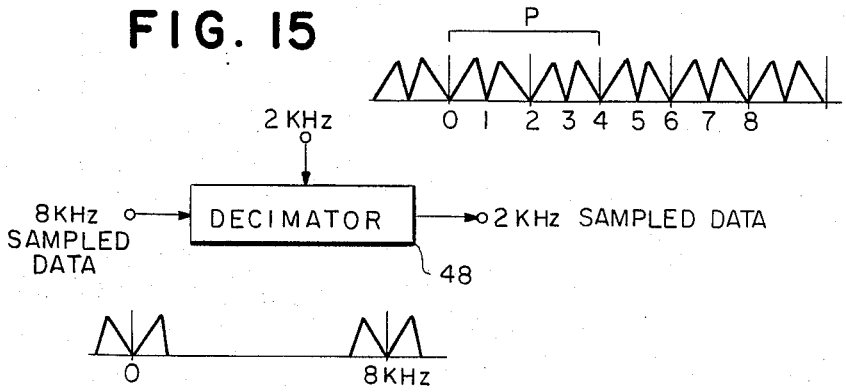

CONFIDENTIAL COMMUNICATION SYSTEM

BACKGROUND OF THE INVENTION

The present invention relates to a communication system for communicating a speech signal confidentially and particularly to an improvement in reducing the selective fading of the confidential communication system which transmits speech feature parameters instead of speech signal itself.

The confidential communication system transmits spectrum envelope information representing macroscopic spectrum distribution and exciting source information representing microscopic spectrum distribution as speech feature parameters, and is widely used in various fields because of its high capability of secrecy.

Such speech feature parameters are transmitted through a plurality of frequency sub-bands (multiple paths) of radio frequency band by utilizing low-bit rate CODEC such as a vocoder, thereby reducing the problem in the transmission channels.

In the above-mentioned conventional confidential communication system, however, the multiple paths are formed through the reflection from the ionosphere. Therefore, in the communication channel there may be caused a selective fading in a frequency band sufficiently narrow compared with the speech band, thereby resulting in multiple null receptions by mutual interference of multipath-transmitted signals. Moreover, in the mobile communication system, the null frequency moves randomly at high speeds depending on the path difference and the carrier frequency, making it impossible to use such a system except under only limited operating conditions.

SUMMARY OF THE INVENTION

The object of this invention is to provide a confidential communication system capable of removing the fading influence due to the multipath transmission.

Another object of the invention is to provide a confidential communication system having a simplified hardware configuration.

According to the present invention, the respective feature parameters extracted from a speech signal are converted into the corresponding line spectrum data in a first frequency band obtained by dividing the speech signal frequency band. Each of the line spectrum data is allocated previously to each one of the feature parameters. The extracted feature parameters are further converted into the corresponding line spectrum data in the other divided frequency bands other than the first frequency band. The converted line spectrum data are multiplexed for transmission. The corresponding line spectrum data in the divided frequency bands allocated to the same feature parameter are logically added (ORed) to restore the feature parameters. Thus higher secure communication is realized.

Other objects and features of the invention will become apparent from the following descriptions in conjunction with the attached drawings.

BRIEF DESCRIPTION OF THE DRAWINGS

FIG. 10 is a frequency multiplexer processing diagram performed by the frequency multiplexer of FIG. 8;

FIG. 11 is a block diagram showing the details of a power spectrum analyzer 22, a peak picker 23 and a combiner 24 in the first embodiment of FIG. 1;

FIG. 13 is a block diagram of the second embodiment of this invention;

FIG. 15 is a decimator processing diagram showing the effect of the decimator 48 in the third embodiment of this invention.

PREFERRED EMBODIMENTS OF THE INVENTION

Figure 1:
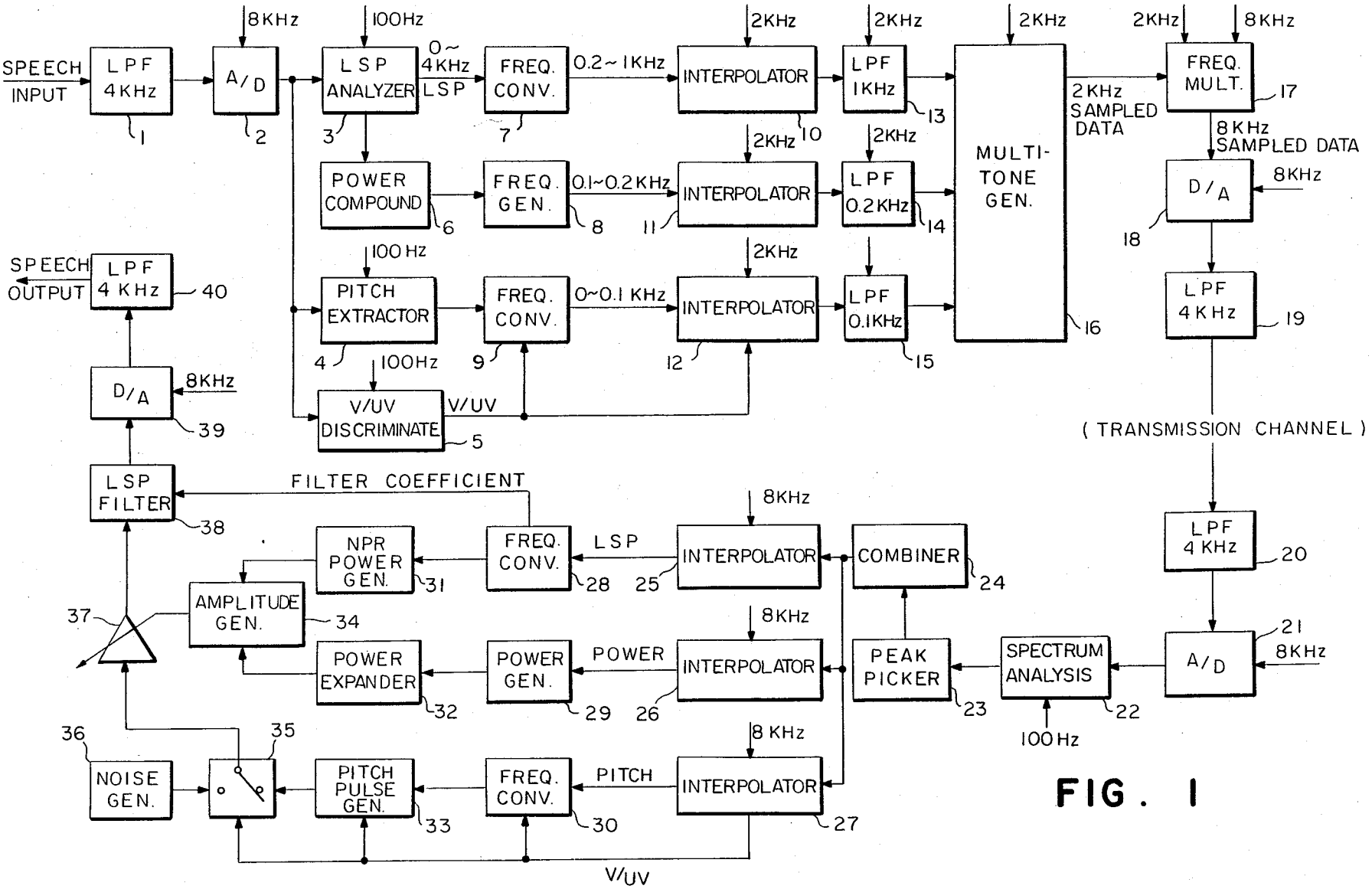
FIG. 1 is a block diagram showing the first embodiment of this invention.

In FIG. 1, an input speech signal is passed through a low pass filter 1 for removing frequency components higher than 4 kHz, and then supplied to an A/D converter 2. The A/D-converted signals are sampled at the sampling frequency of 8 kHz and quantized into 12-bit numbers which are then fed to an LSP analyzer 3 and a pitch extractor 4, and a V/UV (voiced/unvoiced) discriminator 5.

The LSP analyzer 3 extracts 10th order LPC (linear prediction coding) coefficients from the input signal at 100 Hz timing, i.e., every 10 milliseconds, called a "frame", and from the LPC coefficients LSP (line spectrum pairs) frequencies of 10th order are developed. Thus developed LSP frequencies and a short time average speech power for each frame are supplied to a frequency converter 7 and a power compressor 6, respectively. The LSP frequencies represent the spectrum envelope of input speech signal for each frame and range within 0~4 kHz.

The pitch extractor 4 extracts a pitch frequency of the input speech for each frame and supplies it to a frequency converter 9. The V/UV discriminator 5 extracts the voiced/unvoiced information and supplies it to the frequency converter 9 and a linear interpolator 12. The power compressor 6 performs the specified non-linear compression on the received short time average speech power and the compressed power data is fed to a frequency generator 8. The pitch, V/UV and power information as the exciting source information and the spectrum envelope parameters represent the input speech parameters.

The frequency converter 7 linearly converts the frequency data of 0 to 4 kHz as signed to the received LSP frequency data into the frequency data of 0.2 to 1 kHz. The frequency generator 8 generates frequency signal within 0.1 to 0.2 kHz in accordance with the level of the input power data. The frequency converter 9 converts, in response to the V/UV information, the pitch frequency into zero frequency when a UV signal is received and, when it is a V signal, into a specified frequency ranging 0 to 0.1 kHz according to the pitch frequency. In this way, all the exciting source information are converted into line spectrum data within the frequency band from 0 to 1 kHz and are supplied to the respective linear interpolators 10, 11, 12.

The linear interpolators 10, 11 and 12, at 2 kHz timing, performs linear interpolation on the data thus supplied. The interpolation processing timing basically requires 8 kHz but, because of the reason described later, the 2 kHz timing is used here. The 2 kHz timing is also used in low pass filters LPF 13, 14, 15 and a tone generator 16.

The low pass filters LPF 13, 14, 15 making up the transversal filter are each driven by 2 kHz clock and have high cutoff frequencies of 1 kHz, 0.2 kHz and 0.1 kHz respectively. These LPFs feed the filtered LSP frequency data, power frequency data and pitch frequency data to the multitone generator 16.

Figure 2:
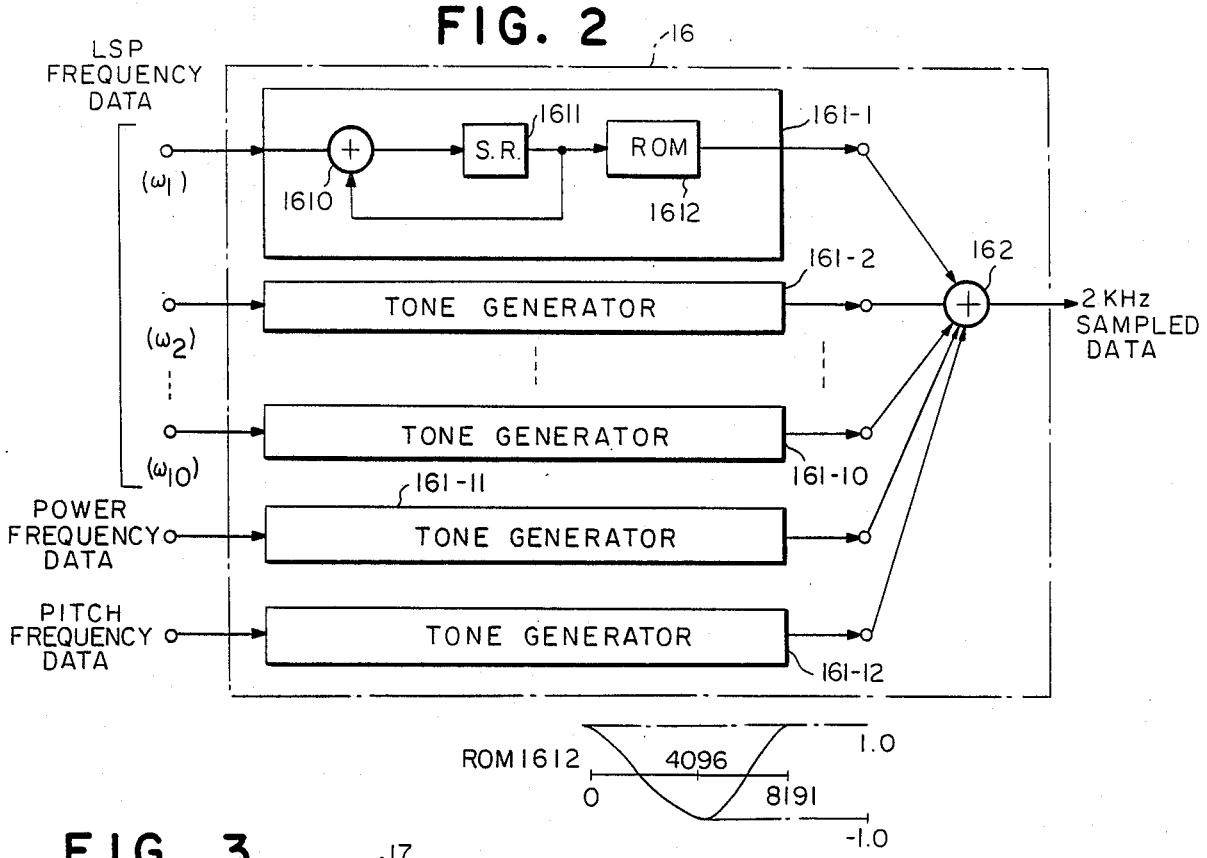
FIG. 2 is a block diagram showing the detail of a multitone generator 16 of the first embodiment as shown in FIG. 1.

FIG. 2 is the block diagram showing the details of the multitone generator 16 of the embodiment in FIG. 1.

The LSP frequency data provided from LPF 13 is the 10th order LSP frequencies $\omega_1, \omega_2, \ldots, \omega_{10}$. Along with these ten frequencies, the power frequency data and the pitch frequency data including the V/UV information are supplied to tone generators 161-1 to 161-12 as the line spectrum data. The function of these tone generators is explained below with the tone generator 161-1 taken as an example.

The tone generator 161-1 consists of an adder 1610, a shift register 1611 and a ROM 1612. The shift register 1611 has a configuration in which one word is made up of 13 bits (capable of representing 0–8191 steps). The shift register delays its input by 2 kHz clock and feeds the output back to the input side. The adder 1610 adds the fed-back output to the input and provides the added signal to the ROM 1612. Thus, the signal of the shift register goes high to a step of 0 to 8191 at varying speeds depending on the value of $\omega_1$ received. The inclination of the leading edge corresponds to the value of $\omega_1$. Each input data is an integer proportional to the frequency value represented by each data. For instance, an integer representing 500 Hz is 512 in this embodiment.

The ROM 1612 stores in its addresses of 0 to 8191 the sinusoidal wave data, which may take a value of, say, +1.0 at address 0, −1.0 at 4096 and +1.0 at 8191. In response to the output of the shift register, the data is read out from the ROM 1612 at 2 kHz timing. The output read out in this way will be a sine wave having frequency corresponding to the value $\omega_1$.

Likewise, the other tone generators, supplied with inputs$\omega_2$ to $\omega_{10}$, power frequency data, and pitch frequency data, produce sinusoidal wave outputs. These 12 sine wave outputs are summed up by the adder 162 to be output as 2 kHz sampled data.

Figure 3:
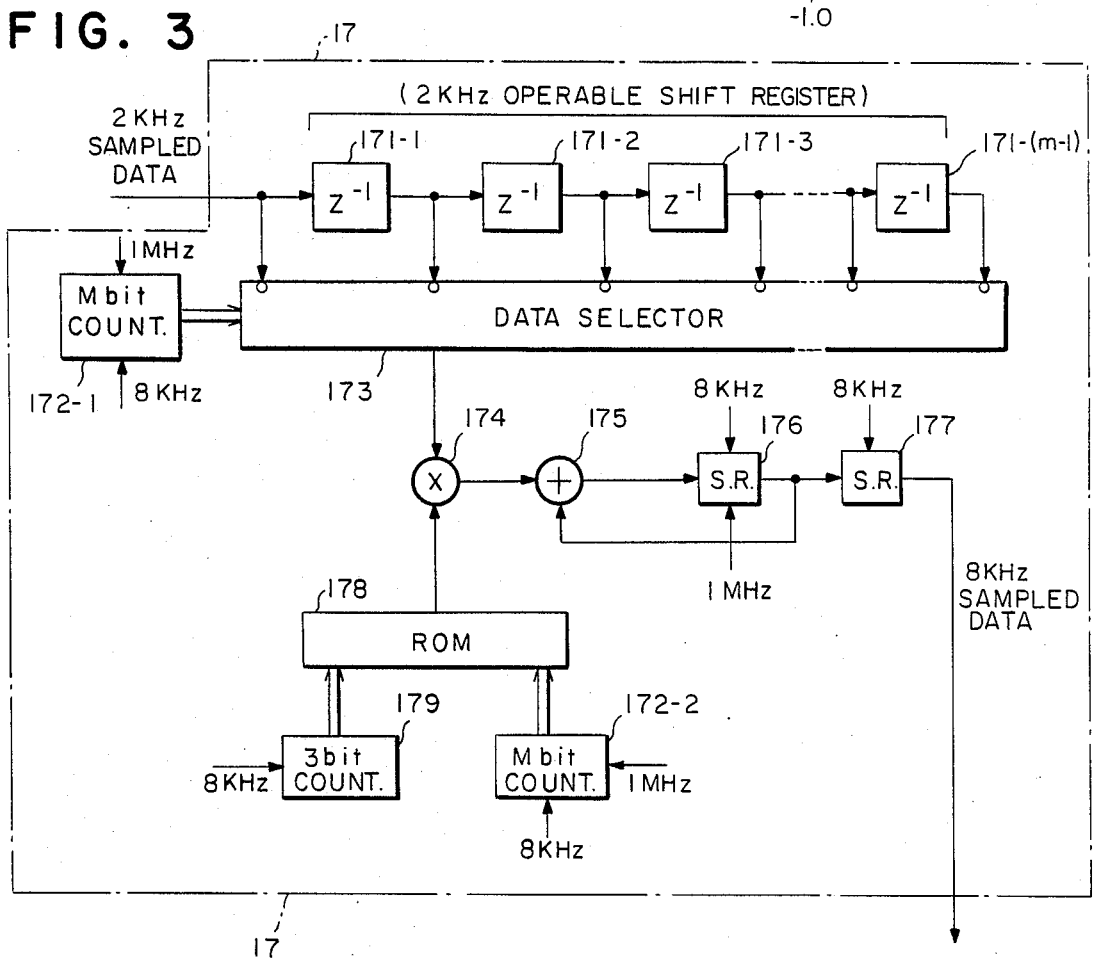
FIG. 3 is a block diagram showing an example of a frequency multiplexer 17 of the first embodiment as shown in FIG. 1.

FIG. 3 shows a block diagram giving the details of the frequency multiplexer 17 in the embodiment of FIG. 1. According to the frequency multiplexer 17, 8 kHz sampled data in four frequency bands (channels): 0 to 1, 1 to 2, 2 to 3, and 3 to 4 kHz are obtained from the 2 kHz sampled data distributed over the range of 0 to 1 kHz. The four-channel transmission brings about the frequency diversity effect that will reduce the fading phenomena substantially on the following grounds:

FIG. 3 shows the configuration of the frequency multiplexer that realizes the aforementioned processing. The frequency multiplexer consists basically of (m−1) stages of registers and eight sets of m filter coefficient memories. The fundamental operating principle will be explained later.

Unit delay elements 171-1 to 171-(m−1) form a (m−1) stage shift register to shift the 2 kHz sampled data and apply the shifted data to a data selector 173 at 2 kHz timing.

An M-bit counter 172-1 resets its data at 8 kHz timing and sends the counted data at high frequency (for example 1 MHz) to the data selector 173. M denotes the number of bits that can represent the m described later. When m=8, then M=3.

The data selector 173 selects the signal from the stage terminals of the shift register according to the counted data by the M-bit counter 172-1 and obtains 8 sets of m inputs, these 8 sets correspond to phase 0 to phase 7. Then the data selector 173 supplies these inputs to a multiplier 174.

To the multiplier 174 8 m filter coefficients read out from a ROM 178 are supplied. The filter coefficients are read out from ROM 178 responsivet to the set phase 0 to 7 by a 3-bit counter 179 that is driven every 8 kHz, and the addresses for the 8 m filter coefficients stored in the ROM 178 determined by an M-bit counter 172-2, which is the same configuration as the M-bit counter 172-1.

The multiplier 174 multiply the data from the data selector 173 by the filter coefficients from the ROM 178, and outputs the multiplied data to a shift register 176 through an adder 175.

The shift register 176 accumulates the filter coefficient multiplication results for the phases 0 to 7, feeds the multiplication results to the adder 175 and supplies to a shift register 177 the accumulated result at the 8 kHz timing wherein the accumulated signal is sampled at a 8 kHz sampling frequency. The frequency multiplexing is easily accomplished in this way.

Now, referring to FIGS. 4 and 5, another example 41 of the frequency multiplexer will be explained in detail.

A signal S41 from an input terminal 4100 is, in this case, 8 kHz sampled data having frequency spectrum ranging from 0 to 1 kHz and contains the LSP frequency data, power frequency data and pitch frequency data. These data are supplied from the multitone generator 16. Thus, when this configuration 41 is employed, it is assumed that the linear interpolators 10–12, LPFs 13–15 and multitone generator 16, all shown in FIG. 1, are driven at the 8 kHz timing.

Figure 4:
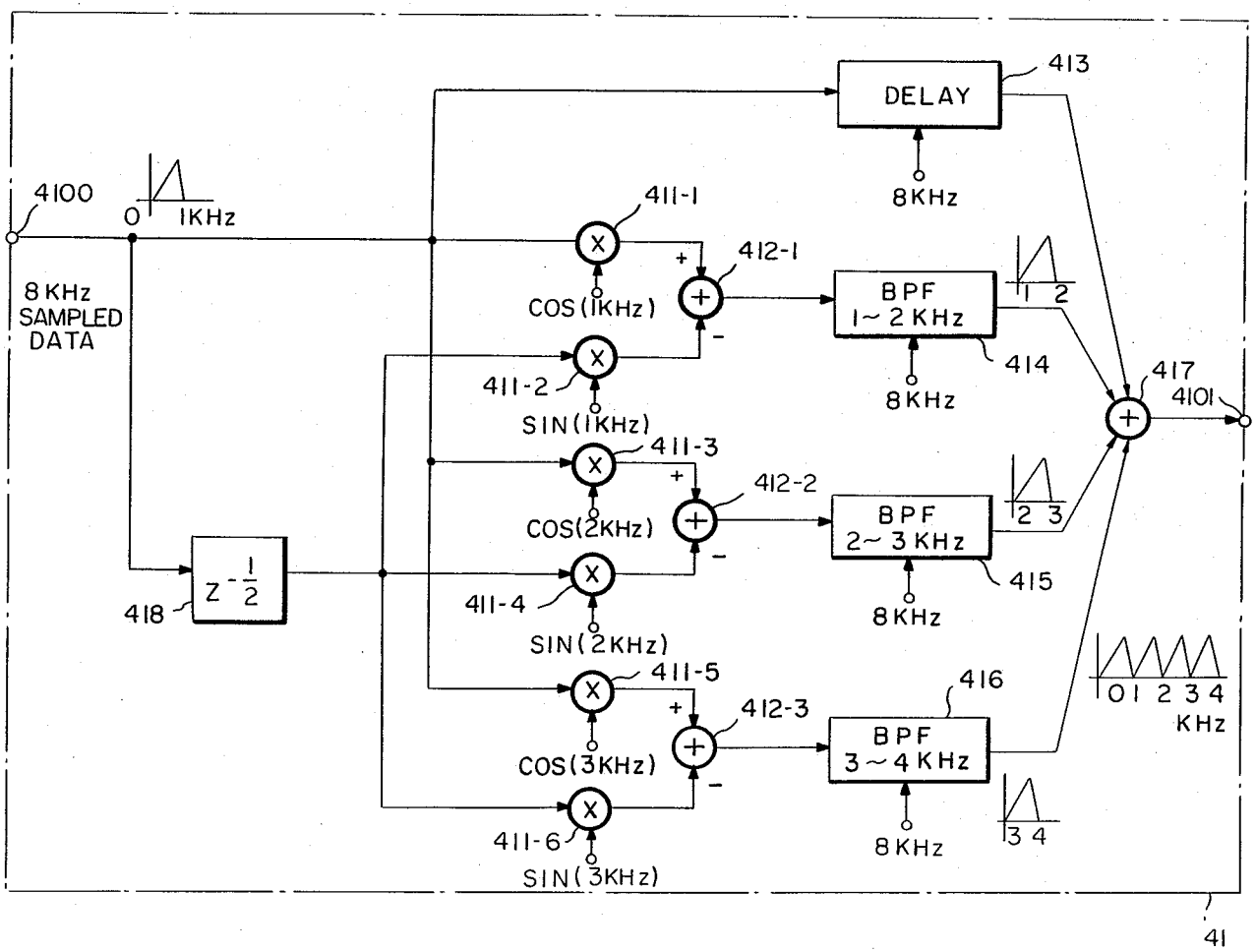
FIG. 4 is a block diagram showing another example of the frequency multiplexer of the first embodiment.

In FIG. 4, multipliers 411-1, 411-3, 411-5 respectively multiply the data S41 by cos(1 kHz), cos(2 kHz), cos(3 kHz). S43 and S44 of FIG. 5 are examples of multiplication result representing the outputs of multipliers 411-1 and 411-2. The multiplication results are given to adders 412-1 to 412-3. Multipliers 411-2, 411-4, 411-6 are each supplied with SIN(1 kHz), SIN(2 kHz), SIN(3 kHz) by which to multiply the 8 kHz sampled data S42. The results of multiplications are output to the adders 12-1, 412-2, 412-3. The sampled data S42 supplied to the multipliers 411-2, 411-4, 411-6 are the sampled data S41 delayed by ½ of the fundamental period of 8 kHz by a ½ delay element 418. When the spectrum S41 are all real number signal, the spectrum S42 are all imaginary number signal. The adders 412-1, 412-2, 412-3 subtract the outputs of multipliers 411-2, 411-4, 411-6 from the outputs of multipliers 411-1, 411-3, 411-5. As a result, the adder 412-1 produces a series of 8 kHz sampled data S45 up-shifted by 1 kHz from the original data to the frequency band of 1 to 2 kHz; the adder 412-2, a series of 8 kHz sampled data up-shifted by 2 kHz to the frequency band of 2 to 3 kHz; the adder 412-3, a series of 8 kHz sampled data up-shifted by 3 kHz to the frequency band of 3 to 4 kHz.

These adder outputs are then filtered by band pass filters 414, 415, 416 into the frequency bands of 1–2 kHz, 2–3 kHz and 3–4 kHz to remove unnecessary frequency components. These band pass filters in this embodiment employ transversal filters that are driven at the 8 kHz clock.

The outputs from these band pass filters have a delay time δ with respect to the input timing of 8 kHz sampled data. Therefore, the 8 kHz sampled data of 0–1 kHz frequency band is delayed through a delay circuit 413 with the delay time δ. Thus, it is possible to obtain the 8 kHz sampled data multiplexed over the four frequency bands of 0–1, 1–2, 2–3 and 3–4 kHz. It is noted that in FIG. 4 the delay circuits 413 and band pass filters 414, 415, 416 are basically not necessary.

Figure 6:
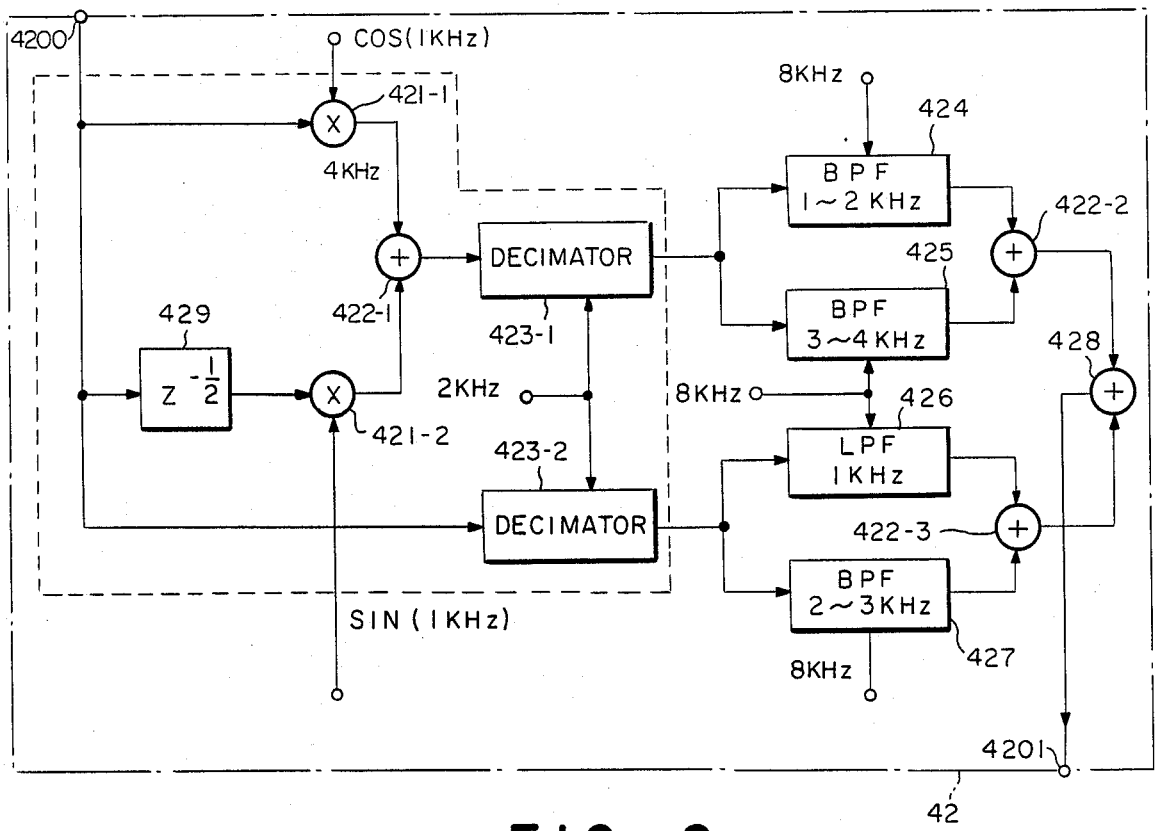
FIG. 6 is a block diagram showing a still another example of the frequency multiplexer which has a modified (simplified) configuration of the frequency multiplexer of FIG. 4.

The aforementioned frequency multiplexer 41 can be modified to a substantially simplified configuration by utilizing a so-called decimation which reduces the sampling rate as shown in FIG. 6.

In this modified frequency multiplexer 42, 4 kHz sampled data over the 0 to 1 kHz band is taken in from the input terminal 4200 instead of the 8 kHz sampled data.

A multiplier 421-1 multiplies the 4 kHz sampled data by cos(1 kHz); and a multiplier 421-2 multiplies by SIN(1 kHz) the 4 kHz sampled data which has been delayed by half the fundamental period of 8 kHz through a ½ delay element 429. These multiplied 4 kHz sampled data are summed up by an adder 422-1, after which the added value is supplied to a decimator 423-1.

A decimator 423-2 is supplied with unprocessed 4 kHz sampled data. These two decimators sample the input at the invervals of 2 kHz for decimation, the output of the decimator 423-1 being supplied to BPF 424, 425 and the output of the decimator 423-2 to LPF 426 and BPF 427.

Figure 7:
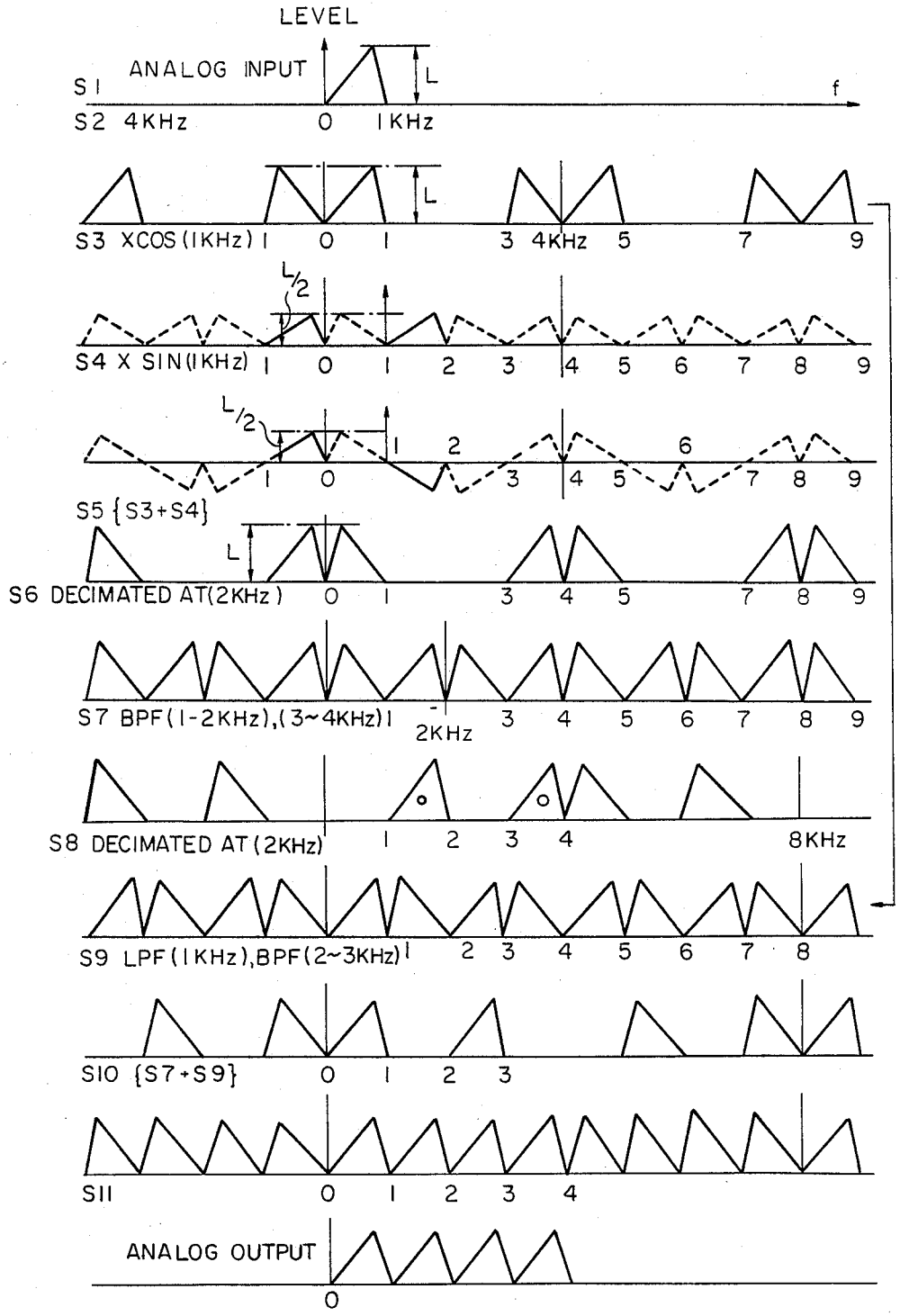
FIG. 7 is a major signal frequency spectrum characteristic diagram showing the major signals' frequency spectrum characteristics of the frequency multiplexer as shown in FIG. 6.

Referring to FIG. 7, the spectrum S1 is an analog spectrum with the maximum level of L and contains in the frequency range of 0 to 1 kHz the information on the 10th order LSP frequencies, power, and pitch frequency with V/UV information.

The spectrum S1, when sampled at the 4 kHz timing, becomes the spectrum S2. The spectrum S2, after being multiplied by COS(1 kHz), is represented by spectrum S3.

Figure 5:
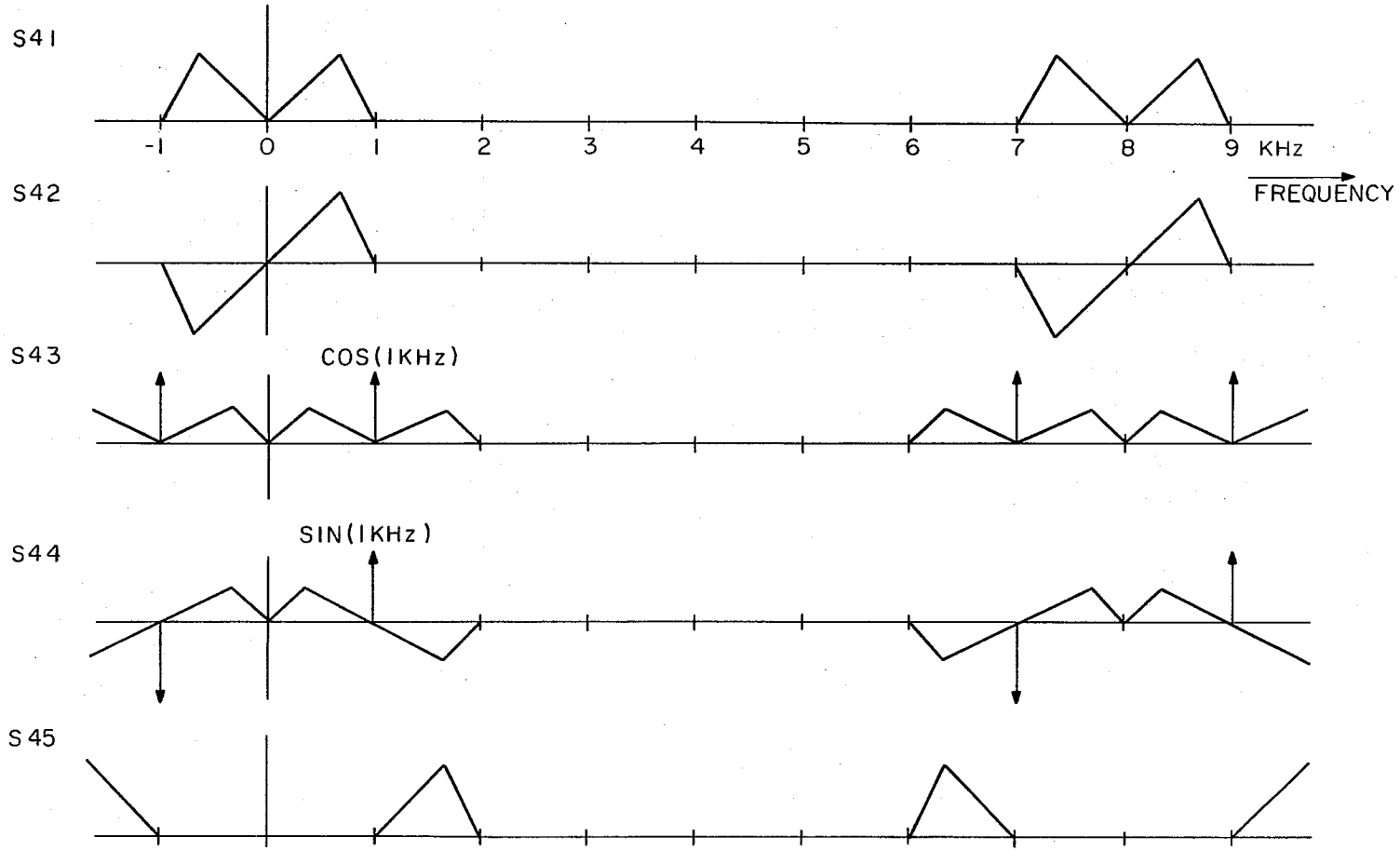
FIG. 5 is a major signal frequency spectrum characteristic diagram showing the major signals' frequency spectrum characteristics of the frequency multiplexer shown in FIG. 4.

A spectrum obtained by delaying the spectrum S1 by half the fundamental period forms, an imaginary component as with FIG. 5 S42, if S2 of FIG. 7 is assumed to be a real component. Multiplying this component by SIN(1 kHz), the spectrum of S4 of FIG. 7 is obtained. In the spectrums S3 and S4, the arrows show the discretely expressed 1 kHz frequency and the broken line represents a spectrum series generated by repeating and folding during modulation of the fundamental 1 kHz frequency. The levels of these spectrum S3 and S4 are reduced to L/2.

Adding the spectrum S3 and S4 produces a spectrum S5 which has its level restored to L. This spectrum S5 is the output of an adder 422-1 and is decimated by a decimator 423-1 at 2 kHz sampling timing before being output as a spectrum S6. A decimator 423-2 is supplied with a spectrum S2 and output the decimated spectrum S8.

Upon receiving the spectrum S6, BPF424 and BPF425 filter it into the frequency band of 1 to 2 kHz and 3 to 4 kHz, respectively. The filtered outputs are fed to an adder 422-2 which performs selective extraction on the spectrum S6 to produce a spectrum S7. The resulting spectrum S7 is then supplied to an adder 428.

LPF426 and BPF427 filter the spectrum S8 into the frequency band of 0 to 1 kHz and 2 to 3 kHz, respectively. The filtered outputs are supplied to an adder 422-3 where selective extraction is performed on them to produce a spectrum S9 which is then fed to the adder 428.

The adder 428 adds the spectrums S7 and S9 to obtain a spectrum S10. The spectrum S10 of an 8 kHz sampled data is supplied to the D/A converter 18 and LPF19 to produce an analog output spectrum S11.

The above modified frequency multiplexer of FIG. 6 can further be simplified in its configuration. The portion enclosed by the broken line in FIG. 6 is the section that produces the spectrum S6 and S8 shown in FIG. 7. A substantial simplification can be achieved as follows.

Figure 8:
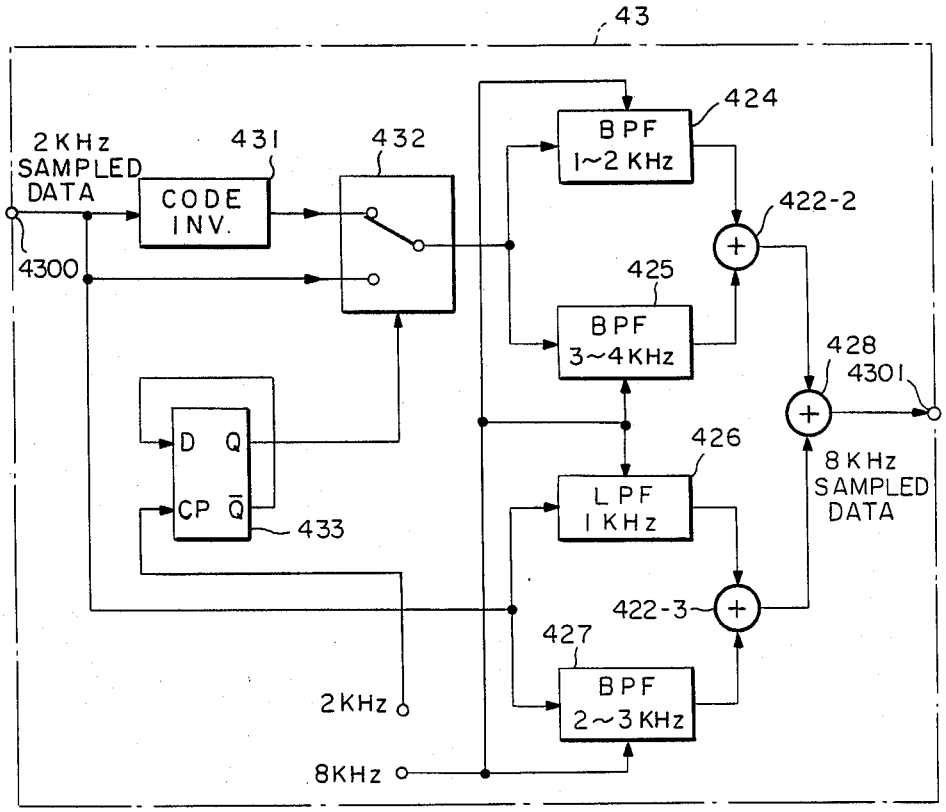
FIG. 8 is a block diagram of a further example of the frequency multiplexer with simplified configuration.

FIG. 8 is a block diagram of the modified frequency multiplexer 43 with a more simplified configuration. The portion shown and contained in the broken line in FIG. 6 is substituted by a circuit made up of a code inverter 431, a switch 432 and a flip-flop circuit 433. Other sections are identical in configuration with those of FIG. 6 and detailed explanation on these sections will not be given.

The input to the frequency multiplexer of FIG. 6 is the 4 kHz sampled data.

Suppose the 4 kHz sampled data is obtained through decimating the 8 kHz sampled data shown in formula (1) by one-half the basic cycle period. The word "decimate", as is well-known, means processing to pick up sampled data at specified timing and is also called "down sample".

$$\ldots X_{-3}, X_{-2}, X_{-1}, X_0 X_1, X_2, X_3, X_4, X_5, X_6, X_7 \quad (1)$$

The 4 kHz sampled data is given by formula (2)

$$\ldots X_{-2}, X_0, X_2, X_4, X_6, X_8, \quad (2)$$

The data series of COS(1 kHz) is expressed as $$\ldots, 0, 1, 0, -1, 0, 1, \ldots \quad (3)$$

The result of multiplying the data series of (2) by that of (3) is given by $$\ldots, 0, X_0, 0, -X_4, 0, X_8, \ldots \quad (4)$$

On the other hand, the 4 kHz sampled data series that has been delayed by ½ fundamental period is expressed by formula (5).

$$\ldots X_{-3}, X_{-1}, X_1, X_3, X_5, X_7, \ldots \quad (5)$$

The data series of SIN(1 kHz) is given by $$\ldots, -1, 0, 1, 0, -1, 0, \ldots \quad (6)$$

The result of multiplying the data series of (5) and that of (6) is expressed by formula (7).

$$\ldots X_{-3}, 0, X_1, 0, -X_5, 0, \ldots \quad (7)$$

Thus, the data series of {(input data)×COS(1 kHz)+(input data delayed by ½ fundamental period)×SIN(1 kHz)} can be expressed by formula (8).

$$\ldots -X_3, X_0, X_1, -X_4, -X_5, X_8, \ldots \quad (8)$$

When the data series of (8) is decimated to 2 kHz, the following series is obtained:

$$\ldots, -X_4, X_0, -X_4, X_8, -X_{12}, \ldots \quad (9)$$

In FIG. 8, the 2 kHz sampled date from the input terminal 4300 is supplied directly to, and through the code inverter 431 to the switch 432. The switch 432 alternates the inputs to produce an output according to the Q terminal output of the flip-flop circuit 433. The flip-flop circuit 433 feeds back the $\overline{Q}$ terminal output of the D type flip-flop as an input, and in response to 2 kHz clock input to the clock terminal CP, produces a 1 kHz pulse at the Q terminal output which is used to drive the switch 432 thereby generating the spectrum S6 as shown in FIG. 7. The 2 kHz sampled data directly supplied to LPF426 and BPF427 is put out as the spectrum S8, therefore, at the output terminal 4301 the same data as that of FIG. 5 is obtained.

For the above reasons, the linear interpolators, low pass filters (LPFs) and multitone generators in FIG. 1 use 2 kHz as a sampling drive frequency instead of 8 kHz. This greatly simplifies the configuration and achieves a significant reduction in the amount of computations quantity required.

The modified frequency multiplexer 43 of FIG. 8 can further be simplified, as described below.

The low pass filter (LPF) of FIG. 8 can be considered as a kind of band pass filter (BPF). Let us consider the case where four BPFs including this LPF are used to form a transversal filter.

Figure 9A:
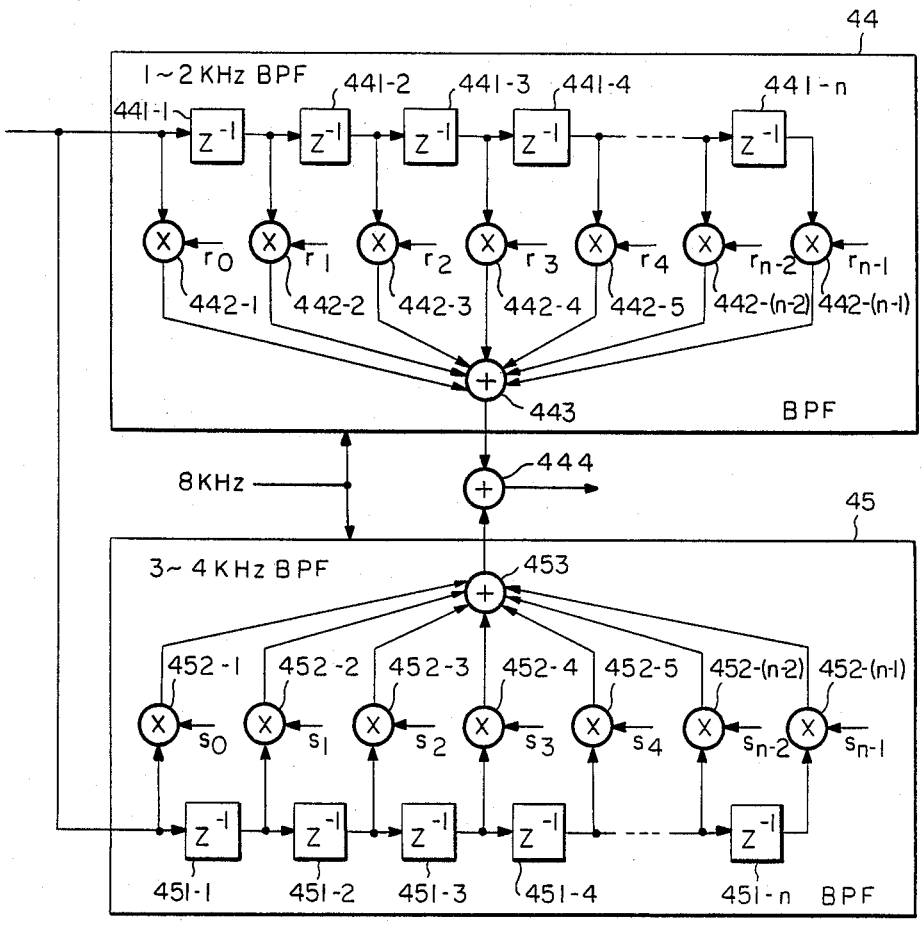
FIGS. 9A and 9B are circuit showing the fundamental configuration of the band pass filter shown in FIG. 8.

FIG. 9A is a circuitry showing the basic configuration of BPF as shown in FIG. 8.

Figure 9B:
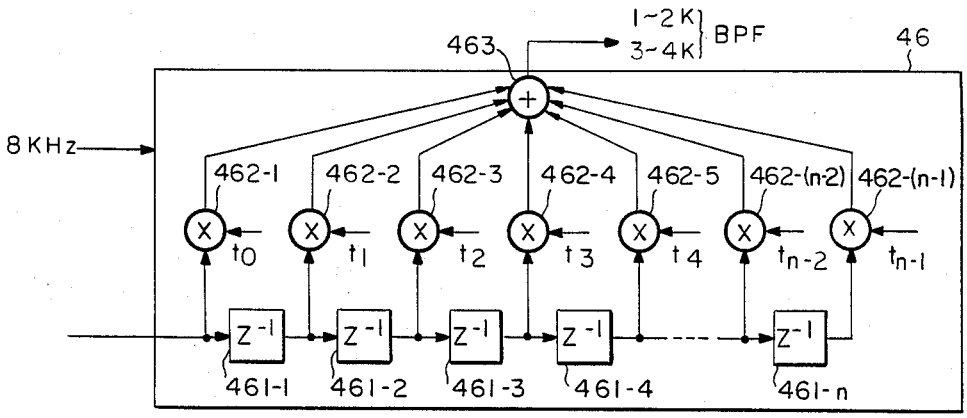

BPF44 and BPF44 have pass bands of 1 to 2 kHz and 3 to 4 kHz and are transversal filters with filter coefficients of $r_0$ through $r_{n-1}$ and $S_0$ through $S_{n-1}$, respectively. BPF44 has n unit delay elements 441-1 to 441-n, multipliers 442-1 to 442-(n−1) and an adder 443. BPF45 has n unit delay element 451-1 to 451-n, multipliers 452-1 to 452-(n−1) and an adder 453. The outputs of BPF44 and BPF45 are summed up by an adder 444. The functions of these two BPFs can easily be substituted by one BPF, that is, as shown in FIG. 9B, they can be realized by BPF46. BPF46 also is a transversal filter with n stages, made up of n unit delay elements 461-1 to **461-*n*, multipliers 462-1 to 462-(n−1) and an adder 463**. The filter coefficients are $t_0$ to $t_{n-1}$ where $t_i = r_i + s_i$ ($i=0, 1, 2, \ldots (n-1)$). Thus, BPF with the pass band of 1 to 2 kHz and 3 to 4 kHz can be realized by a single transversal filter.

LPF and BPF which respectively have the pass bands of 0 to 1 kHz and 2 to 3 kHz can also be formed with a single transversal filter. Therefore, the four BPFs in FIG. 8 can be realized with two transversal filters.

Now, if we express the input 2 kHz sampled data as $y_0, y_1, y_2, \ldots$ and if, of the above two BPFs with two pass bands, the (1–2, 3–4 kHz) filter is supposed to have the filter coefficients of $u_0, u_1, \ldots u_{n-1}$, then these filter coefficients can generally be represented by FIG. 10 (*a*). FIG. 10 shows the frequency multiplexing processing as performed by the frequency multiplexer of FIG. 8.

Suppose the state of 2 kHz sampled data at a certain timing for phase 0 is expressed by the sampled data $(b)^1$, for instance, $y_7 \ldots y_2, 0, 0, 0, y_1, 0, 0, 0, y_0, 0, 0, 0$. Since the filter is driven at 8 kHz timing, three sample points between the 2 kHz sampled data are necessarily zero. The output in this case is given as an output $(b)^2$ where underlined coefficients are used as filter coefficients for the sampled data $(b)^1$ in phase 0. In phase 1 which is next phase to the phase 0, the filter input and output are expressed by the phase 1 sampled data $(c)^1$ and output $(c)^2$. Likewise, the phase 3 sampled data $(d)^1$ and output $(d)^2$, phase 4 samples data $(e)^1$ and output $(e)^2$ are input and output and this process continues until the filter takes in and out the phase 7 sampling data $(f)^1$ and output $(f)^2$, thus completing the 8 kHz sampling for one cycle. This process continues on the next cycle starting with the phase 0 sampled data $(g)^1$ and its output $(g)^2$.

The above multiplexing processing is summarized as follows. Eight sets of inputs $(b)^1$ to $(b)^7$ obtained by sampling the 2 kHz sampled data at 8 kHz sampling timing are respectively multiplied by m filter coefficients indicated in parentheses and the multiplied values are summed up to produce an output. This is the basic processing.

These filter coefficients, as shown in FIG. 10, are determined by adding together the coefficients of (1–2, 3–4 kHz) BPF and (0–1, 2–3 kHz) BPF, and generally require eight sets of coefficients, each set numbering m, i.e., 8 m filter coefficients. The number m is determined as an interger part of $(n+3)/4$ wherein n is the number of BPF taps; 4 is the divisor required to perform sampling of the 2 kHz sampled data at 8 kHz timing; and 3 is the maximum value of tap fraction for each 8 kHz sampling. For instance, when a BPF with $n=31$ is used, $m=8$ is obtained.

Now, returning to FIG. 1, the 8 kHz sampled data output from the frequency multiplexer 17 is converted into analog data by a D/A converter 18, removed of unnecessary high frequency components and then converted into transmission signals of a specified modulation form. The modulated transmission signals are then transmitted as the frequency-multiplexed signals through a transmission channel to the receiving side.

At the receiving side, the received signals are demodulated and passed through an LPF20 to obtain four-channel components of base band 0 to 4 kHz. The filtered base band components are digitized by an A/D converter 21 at the 8 kHz sampling rate and supplied to a power spectrum analyzer 22.

FIG. 11 is a block diagram showing the details of the power spectrum analyzer 22, a peak picker 23 and a combiner 24. FIG. 12A through FIG. 12H show the operation of the circuit shown in FIG. 11.

The 8 kHz sampled data from the A/D converter 21 is applied to a window processor 221 which performs window processing on the input data by the window function every 32 millisconds. The window processed data are read out by the 100 Hz timing and fed to a 256-point Fourier transformer 223. A Hamming function is used as the window function and supplied from a 256-point (32 msec) Hamming coefficient generator 222 as the 8 kHz, 32 millisec 256-point data.

The 256-point Fourier transformer 223 performs Fourier transformation on the 256-point inputs and feeds the transformed data to a power calculator 224 which calculates power. The number of power values to be calculated in this case is 128, a half of 256 points.

Figure 12A:
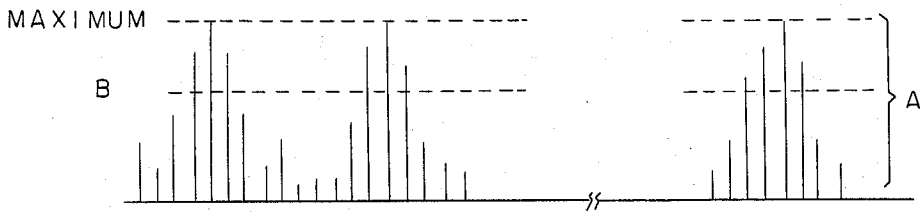
FIGS. 12A to 12H show spectrums to explain the operation of the circuit shown in FIG. 11.

The output of the power calculator 224 is shown in FIG. 12A by A and supplied to a peak picker threshold detector 231 and a peak picker 232. The output of the power calculator 224 is a 4-channel power data having 12 peaks in each of the four 1 kHz bands. The 12 peak values correspond to the 10th order LSP frequencies representing the spectrum envelope, and to the power frequency and pitch frequency as exciting source information. The four channels cited above are the multiplexed four frequency bands of 0–1 kHz, 1–2 kHz, 2–3 kHz and 3–4 kHz.

The threshold detector 231 detects the maximum power spectrum among the power from the power calculator 224 and, according to the level of the maximum value, generates a picking level (threshold) signal B to distinguish the line spectrum from noise. Based on this threshold signal B, the picker 232 performs peak picking on 12 peak values contained in each of the four 1 kHz bands and supplies to the combiner 24 the data of 48 peak values for all the four channels.

Figure 12B:
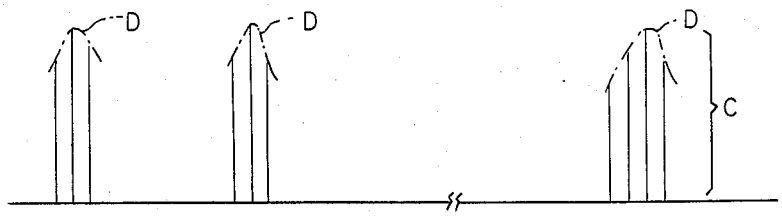
Figure 12C:
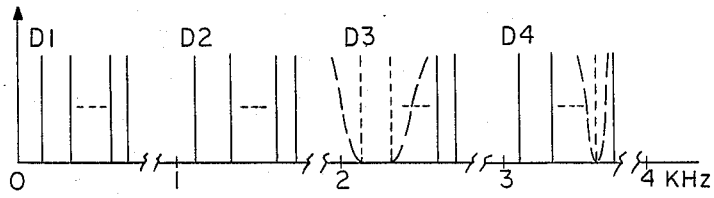
Figure 12D:
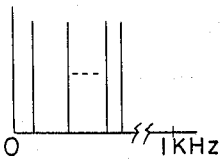
Figure 12E:
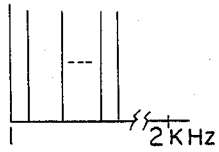
Figure 12F:
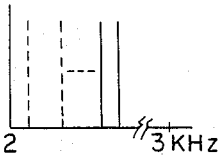
Figure 12G:
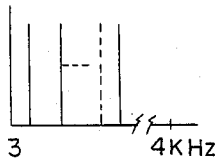
Figure 12H:
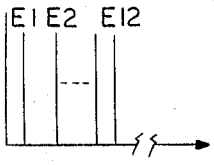

The output of the picker 23 shown in FIG. 12B is fed to a peak frequency detector 241 that detects a peak value signal D of the spectrum. FIG. 12C shows the peak frequency components thus detected that are contained in the four subdivided bands (0–1 kHz, 1–2 kHz, 2–3 kHz, 3–4 kHz) of the speech frequency band 0–4 kHz. Specific frequencies in each of the subdivided bands correspond to the speech feature parameters.

In FIG. 12C, it is shown that fading occurs in the frequency bands indicated by dotted lines where the frequency data is lost. The peak frequency detector 241 supplies the frequency data (D1, D2, D3, D4) representing identical feature parameters to an OR adder 242-1 dedicated to handling that particular feature parameters. Likewise, the frequency data representing other feature parameters are given to the corresponding OR adders 242-2 to 242-12, respectively.

FIGS. 12D through 12G show the frequency data for each of the divided speech bands. It is seen that there are lost signals (shown dotted) caused by fading. These frequency data are added together by the OR adders 242-1 to 242-12 to produce outputs in the form of FIG. 12H. Even when there is a loss of signals, the OR output can be obtained with the lost signals substituted by the corresponding signals of other bands.

Again turning to FIG. 1. Of the outputs of the combiner 24, ten data of LSP frequency are supplied to a linear interpolator 25, data of power frequency to a linear interpolator 26, and data of pitch frequency to a linear interpolator 27 for linear interpolation processing.

The output of the linear interpolator 25 representing the 10th order frequencies ranging from 0.2 to 1 kHz is converted into that ranging from 0 to 4 kHz by a frequency converter 28. The LSP frequency thus obtained is supplied to an LSP filter 38 as the filter coefficients. The LSP filter 38 is of an all-pole speech synthesizing filter.

The LSP frequency output from the frequency converter 28 is also supplied to a normalized predicted residual (NPR) power generator 31 which produces a predicted residual power having the normalized level and sends it to an amplitude information generator 34.

The output of the linear interpolator 26 is fed to a power information generator 29 where the power data in the form of frequency data is converted into power levels representing the power information, which is then supplied to a power expander 32.

The power expander 32 performs the non-linear expanding processing, reversely corresponding to the power compressed by the compressor 6, on the power information and then supplies it to the amplitude information generator 34.

The amplitude information generator 34 adjusts the normalized predicted residual power level to the actual level according to the power information supplied thereto and uses the adjusted residual power level as an amplitude information for gain adjustment of a variable gain amplifier 37.

The pitch frequency in the 0–0.1 kHz band from the linear interpolator 27 is fed to a frequency converter 30 to convert it into the original frequency band. The converted pitch frequency is then supplied to the pitch pulse series generator 33 that, according to the pitch frequency received, produces a pitch pulse series and sends it to the variable gain amplfier 37 through a switch 35.

The linear interpolator 27 supplies the pitch frequency information and V/UV information to a frequency converter 30 and pitch pulse series generator 33 to control the operation of the converter 30 and generator 33. At the same time these information are also given to the switch 35 to control its operation in such a way that when UV is specified by the U/UV information, the output of a noise generator 36 instead of the output of the pitch pulse series generator 33 is fed to the variable gain amplifier 37.

The output of the variable gain amplifier 37 is applied as the exciting source information to the LSP filter 38 to form digital speech signal which are then fed to the D/A converter 39.

The D/A converter 39 converts the input to analog signals and sends them to LPF40 where they are removed of unnecessary high frequency components to produce a speech output.

Figure 14:
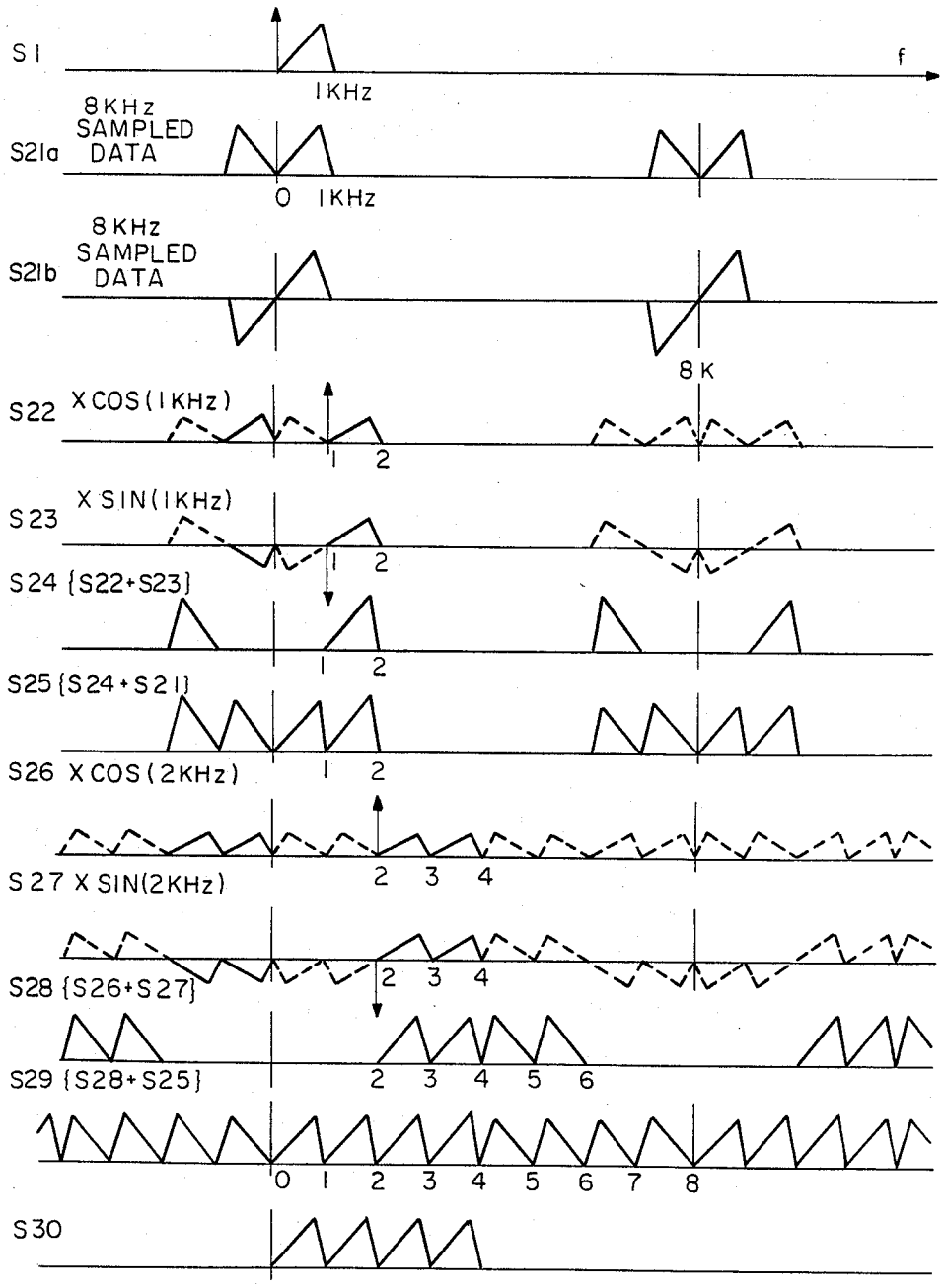
FIG. 14 is a main signal frequency spectrum characteristic diagram showing the frequency characteristics of the main signals of the frequency multiplexer as shown in FIG. 13.

FIG. 13 is a block diagram showing in detail the frequency multiplexer 47 of the second embodiment, and FIG. 14 shows the frequency spectrum characteristics of the major signals processed by the frequency multiplexer 47 of FIG. 13.

The input speech has a spectrum S1. The 8 kHz sampled input speech data is represented by a spectrum S21*a*. The spectrum S21*a* is given to a frequency multiplexer 47. This signal is an output of the multitone generator 16 and contains the 10th order LSP frequencies, the power and U/UV information in the frequency band of 0 to 1 kHz.

In the frequency multiplexer 47, multipliers 471 and 472 respectively receive the spectrum S21*a* and a spectrum S21*b* obtained by delaying S21*a* by $\frac{1}{2}$ fundamental cycle. The multipliers 471 and 472 multiply these spectrums S21*a* and S21*b* by COS(1 kHz) and −SIN(1 kHz) respectively and pass their results to an adder 473.

The output spectrums of multipliers 471 and 472 are represented by S22 and S23. Thus, the output of the adder 473 has a spectrum S24, a sum of these two spectrums. Also supplied to the adder 473 is a spectrum S21 as the 8 kHz sampled data, so the resultant output of the adder 473 has a spectrum S25.

Now, at a multiplier 474 an input having spectrum S25 is multiplied by COS(2 kHz), and at a multiplier 475 the input which has the spectrum S25 delayed by ½ basic cycle period is multiplied by −SIN(2 kHz). The multiplying operation produces outputs with spectrums S26 and S27, respectively. These two outputs are summed up to produce a spectrum output S28. The spectrum S28 is further added with the spectrum S25 from the adder 473, and the resultant 8 kHz sampled output of spectrum S29 is generated. Of this spectrum S29, the 0–4 kHz band is used as an analog output. Similarly, the frequency band data are multiplexed by other modulation scheme than those of the preceding embodiments.

The third embodiment has the linear interpolators, LPFs and multitone generator of the preceding embodiment in FIG. 1 driven by 2 kHz timing. The multiplexer output is obtained basically by decimating the 8 kHz sampled data output from the multitone generator 16 by the decimator 48 using 2 kHz sampling frequency. In this embodiment, the linear interpolators 10 to 12, LPFs 13 to 15, and multitone generator 16 are all driven by 8 kHz timing.

FIG. 15 illustrates the decimator processing showing the effect of the decimator 48 in the third embodiment.

The 8 kHz sampled data entered to the decimator 48 is subjected to decimation process using the 2 kHz sampling frequency in which the data is repeated and folded to produce a 2 kHz sampled data shown in FIG. 15. It is obvious, however, that such an output can easily be obtained by operating the foregoing linear interpolators, LPFs and multitone generator at 2 kHz timing. Therefore, the configuration of the third embodiment can provide to the D/A converter 18 the multiplexed signals with a spectrum indicated by P.

The fourth embodiment differs from the first embodiment only in that it uses a frequency multiplexing multitone generator 49 that also operates as the frequency multiplexer. So explanation on the details of other parts identical with those of the first embodiment is not given.

Figure 16:
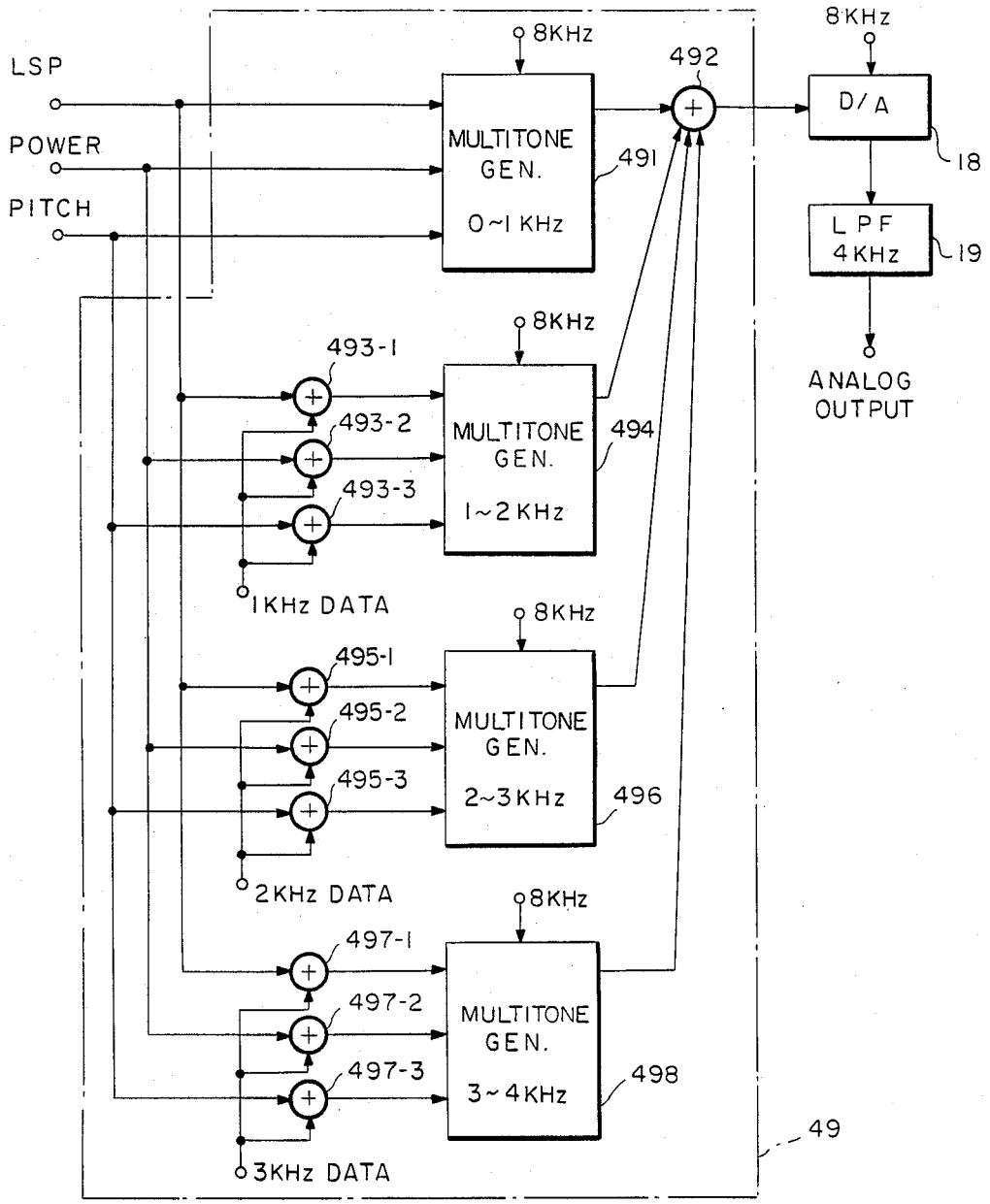
FIG. 16 is a block diagram showing the details of a frequency multiplexing multitone generator 49 of the fourth embodiment of this invention.

FIG. 16 is a block diagram showing the details of a frequency multiplexing multitone generator 49 of the fourth embodiment.

The LSP frequency data, power frequency data and pitch frequency data from LPF 13, 14, 15 are fed to the multitone generator 49. These frequency data are supplied directly to a multitone generator 491 and through adders 493-1 to 493-3, 495-1 to 495-3, 497-1 to 497-3 to multitone generators 494, 496, 498.

These adders add together digital data corresponding to 1 kHz, 2 kHz and 3 kHz and the input frequency data, and provide the result to the multitone generator thereby shifting the input frequency by 1 kHz, 2 kHz and 3 kHz.

The multitone generators 491 to 498 have a configuration almost identical with that of the multitone generator 16 of FIG. 1 and is driven by 8 kHz timing.

The multitone generator 491 supplies to the adder 492 the 8 kHz sampled data ranging 0–1 kHz, the 10th order LSP frequency data ranging from 0.2 to 1 kHz, the power frequency data ranging from 0.1 to 0.2 kHz, and the pitch frequency data containing V/UV information ranging from 0 to 0.1 kHz.

The multitone generator 494 generates an output shifted to the 1–2 kHz frequency band, the multitone generator 496 to the 2–3 kHz band and the multitone generator 498 to the 3–4 kHz band. These multitone generators 494, 496, 498 produce 12-wave outputs same as those of the multitone generator 491 and sends them to the adder 492.

The adder 492 sums up the multitone generator outputs corresponding to the four frequency bands and supplies the resultant value as the frequency-multiplexed 8 kHz sampled data to a D/A converter 18.

The principal feature of this invention is the communication system for keeping a communication secret from third parties, on the basis of speech parameters by using frequency diversity. Therefore, various modifications and deviations may be made to the aforementioned four embodiments.

For example, while the first through fourth embodiments have the speech frequency band divided into four subbands, it is obvious that the number of divided speech bands can be chosen arbitrarily considering the optimum suppression of fading phenomenon.

It is easily understood also that the frequency bands occupied by spectrum envelope and speech exciting source information can be set arbitrarily. These changes can be made without deviating from the essence of this invention.

To summarize this invention, at the transmitting side, the speech signal is converted into speech parameters represented by a plurality of line spectrums to compress the speech band into one of the several divided subbands of the speech frequency band, and the compressed speech parameters are multiplexed over all the channels in the speech band for transmission. At the receiving side, since the above parameters are meaningful in terms of the frequency value but meaningless in terms of the power of parameters, a plurality of line spectrums received through multiple communication channels is logic OR-added to achieve a frequency diversity thereby substantially suppressing the fading problem.

What is claimed is:

1. A communication system comprising:

a feature parameter extraction means for extracting feature parameters from a speech signal;

a frequency conversion means for converting the respective feature parameters into the corresponding line spectrum data, each of which is allocated previously to each of said feature parameters, in a first frequency band obtained by dividing the speech signal frequency band;

a multiplexing means for converting the extracted feature parameters into the corresponding line spectrum data in the other divided frequency bands other than said first frequency band and multiplexing all of the converted line spectrum data; and a logically adding means for logically adding the corresponding line spectrum data in the divided frequency bands allocated to the same feature parameter.

2. A system as set forth in claim 1, wherein said first frequency band is 0 to 1 KHz and said other divided frequency bands are 1 to 2 KHz, 2 to 3 KHz and 3 to 4 KHz.

3. A system as set forth in claim 1, further comprising a D/A converter for converting the output of said multiplexing means into an analog signal and a filter means for extracting only the signals in the speech frequency band from the output of said D/A converter.

4. A system as set forth in claim 1, further comprising a compressing means for performing non-linear processing on at least one of said feature parameters to compress the parameters.

5. A system as set forth in claim 1, further comprising a linear interpolator for linearly interpolating the line spectrum data at specified frequency timing.

6. A system as set forth in claim 1, wherein said feature parameter extraction means extracts spectrum data, power data, pitch data and voiced/unvoiced (V/UV) data of the speech signal.

7. A system as set forth in claim 6, further comprising a compression means for compressing non-linearly said power data.

8. A system as set forth in claim 6, wherein said spectrum data is line spectrum pairs (LSP).

9. A system as set forth in claim 6, wherein said multiplexing means converts said spectrum data into signals in the 0.2–1 kHz band, said power data into signals in the 0.1–0.2 kHz band, and said pitch data and V/UV data into signals in the 0–0.1 kHz band.

10. A system as set forth in claim 5, further comprising a band pass filter interposed between said linear interpolator and said multiplexing means.

11. A system as set forth in claim 1, wherein said multiplexing means has a multitone generator which generates a multiple sinusoidal wave signals corresponding to the frequencies of said line spectrum data.

12. A system as set forth in claim 11, wherein said multitone generator comprises a plurality of tone generators provided for each of the line spectrum data and a first adder for adding together the outputs of said tone generators, each of said tone generators including a second adder for adding the line spectrum data and an another input thereto, a shift register, supplied with the output of said second adder as an input, for supplying its output to said another input, and a memory for storing the sinusoidal wave data and outputting specific sinusoidal wave data in response to the output of said shift register.

13. A system as set forth in claim 1, wherein said multiplexing means includes a first shift register driven by a first frequency clock, a counter for counting a second frequency clock, a data selector for selecting the specified stage of said first shift register in response to the output of said counter, a multiplier for multiplying the output of said data selector by a second input, a memory for storing predetermined filter coefficients and, in response to the output of said counter, outputting a specific filter coefficient as said second input, an adder for adding the output of said multiplier and an input thereto, a second shift register, supplied with the output of said adder and driven by said second frequency clock, for supplying its output as said second input of said adder, and a third shift register, supplied with the output of said second shift register and driven by a predetermined frequency clock, for producing the multiplexed output.

14. A system as set forth in claim 1, wherein said multiplexing means comprises a first multiplier for multiplying the input line spectrum data by a cosine wave signal having a frequency corresponding to the one of said divided frequency bands, a delaying means for delaying the line spectrum data by one-half the sampling period of said line spectrum data, a second multiplier, provided corresponding to said first multiplier, for multiplying the delayed line spectrum data by a sine wave signal having the same frequency as that of the cosine wave signal, a first adder for adding the outputs of said first and second multipliers, a plurality of band pass filters each having frequency band equal to each of the divided bands, and a second adder for adding the outputs of said band pass filters and the line spectrum data to produce an output as the multiplexed signal.

15. A system as set forth in claim 14, further comprising a delay means for delaying the line spectrum data by a specified time period.

16. A system as set forth in claim 1, wherein said multiplexing means comprises a first multiplier for multiplying the line spectrum data by a cosine wave signal having specified frequency determined by said first frequency band, a delaying means for delaying the line spectrum data by one-half the sampling period of the line spectrum data, a second multiplier for multiplying the output of said delaying means by a sine wave signal having a specified frequency equal to that of the cosine wave signal, a first adder for adding the outputs of the first and second multipliers, a first decimator for decimating the output of said first adder by a specified decimate frequency, a second decimator for decimating the line spectrum data by the specified decimate frequency, a plurality of filter means, driven by a frequency clock higher than the specified decimate frequency, for filtering the output of said first and second decimators for the respective divided frequency bands, a plurality of second adders for adding the outputs of predetermined ones of said plural filter means, and a third adder for adding the outputs of said plural second adders.

17. A system as set forth in claim 1, wherein said multiplexing means comprises a code inverter means for inverting the code of the line spectrum data, a flip-flop driven by a predetermined first frequency clock, has $\overline{Q}$ terminal output connected to the D input terminal and a Q terminal output, a switch means for outputting alternatively the outputs of said code inverter means and the line spectrum data in response to the Q terminal output of said flip-flop, a plurality of filter means, driven by a frequency clock higher than said first frequency, for filtering the output of said switch means and the line spectrum data for the respective divided frequency bands, a plurality of first adders for adding the outputs of the preselected of said filter means, and a second adder for adding the outputs of said first adders.

18. A system as set forth in claim 1, wherein said multiplexing means comprises a first multiplier for multiplying the line spectrum data by a cosine wave signal of a first frequency, a first delaying means for delaying the line spectrum data by one-half the sampling period of the line spectrum data, a second multiplier for multiplying the output of said first delaying means by a sine wave signal of the first frequency, a first adder for adding the line spectrum data and the outputs of said first and second multipliers, a third multiplier for multiplying the output of said first adder by a cosine wave signal of a second frequency, a second delaying means for delaying the output of said first adder by one-half the sampling period of the line spectrum data, a fourth multiplier for multiplying the output of said second delaying means by a sine wave signal of the second frequency, and a second adder for adding the line spectrum data and the outputs of said third and fourth multipliers and then producing an output as a multiplexed signal.

19. A system as set forth in claim 1, wherein said multiplexing means comprises a plurality of multitone generators, provided for each of the divided frequency bands, for producing a plurality of frequency signals for each of the line spectrum data, first adders, connected to the inputs of said multitone generators except one, for adding digital data determined on the basis of the divided frequency bands to the line spectrum data, and a second adder for adding the outputs of said multitone generators.

20. A system as set forth in claim 1, further comprising an extracting means, supplied with the multiplexed signals, for determining the line spectrum data for each of the divided frequency bands and extracting the feature parameters and providing the determined line spectrum data to said logically adding means, and a synthesizing filter for synthesizing a replica speech signal according to the feature parameters.

21. A system as set forth in claim 20, further comprising an expander means for expanding non-linearly the extracted power data to cancel the effect given by said non-linear compression means.

22. A system as set forth in claim 20, wherein said extracting means includes a frequency analyzer for frequency-analyzing the multiplexed signals, a means for searching a maximum value of the output of said frequency analyzer and determining a threshold value to distinguish between the line spectrum and noise based upon the maximum value detected, and a peak picking means for picking up a frequency-analyzed signal having a higher level than the threshold and supplying the picked up signals to said logically adding means.

23. A system as set fort in claim 20, further comprising linear interpolators for performing a linear interpolation on the extracted feature parameters.

24. A method of communicating a speech signal confidentially, comprising the steps of:

extracting feature parameters from the speech signal;

converting the respective feature parameters into the corresponding line spectrum data, each of which is allocated previously to each of said feature parameters, in a first frequency band obtained by dividing the speech signal frequency band;

converting the extracted feature parameters into the corresponding line spectrum data in the other divided frequency bands other than said first frequency band and multiplexer all of the converted line spectrum data; and logically adding the corresponding line spectrum data in the divided frequency bands allocated to the same feature parameter.

* * * * *